United States Patent [19]

Hasegawa et al.

[11] 4,070,255

[45] Jan. 24, 1978

[54] PROCESS FOR ELECTROLYTICALLY COLORING ALUMINUM AND ALUMINUM ALLOYS

[75] Inventors: Mutsuo Hasegawa, Uozu; Kazuo Aikawa, Toyama; Katsuyuki Nagata, Uozu, all of Japan

[73] Assignee: Yoshida Kogyo K.K., Tokyo, Japan

[21] Appl. No.: 663,568

[22] Filed: Mar. 3, 1976

[30] Foreign Application Priority Data

Mar. 6, 1975 Japan ..... 50-26518

[51] Int. Cl.[2] ..... C25D 11/22

[52] U.S. Cl. ..... 204/42; 204/35 N

[58] Field of Search ..... 204/35 N, 58, 56 R, 204/42, DIG. 9

[56] References Cited

U.S. PATENT DOCUMENTS

| | | | |
|---|---|---|---|
| 3,773,631 | 11/1973 | Immel et al. | 204/58 |
| 3,912,602 | 10/1975 | Zweifel et al. | 204/58 |
| 3,929,593 | 12/1975 | Sugiyama et al. | 204/35 N |
| 3,977,948 | 8/1976 | Martinez | 204/35 N |

FOREIGN PATENT DOCUMENTS

| | | | |
|---|---|---|---|
| 2,444,398 | 3/1975 | Germany | 204/35 N |

*Primary Examiner*—G. L. Kaplan

*Attorney, Agent, or Firm*—Hill, Gross, Simpson, Van Santen, Steadman, Chiara & Simpson

[57] ABSTRACT

Aluminum or aluminum alloy is first anodized to form an oxide film thereon. With the pores in this oxide film unsealed, the basis metal is then electrolyzed by use of alternating current at a preselected starting voltage, and this voltage is lowered at least once before completion of the electrolytic coloring of the basis metal. The electrolytic solution in which the electrolysis is effected contains either at least three metallic salts or at least two metallic salts and a strong reducing compound.

7 Claims, No Drawings

PROCESS FOR ELECTROLYTICALLY COLORING ALUMINUM AND ALUMINUM ALLOYS

BACKGROUND OF THE INVENTION

1. Field of the Invention

This invention relates to a process for electrolytically coloring aluminum or any of its various alloys.

2. Prior Art

For electrolytic coloring of aluminum or aluminum alloy, there has been suggested and practiced extensively a process wherein the basis metal is first anodized to form an oxide film thereon and then electrolyzed in an electrolytic solution containing a metallic salt such as a nickel salt by use of alternating or direct current. The basis metal is colored by electrodeposition of the metal or metal oxide in the pores of the oxide film thereon.

Such a prior art process is generally poor in throwing power, so that particularly in the case of an irregularly shaped workpiece, its protuberant and recessed portions tend to be colored in noticeably different shades. Moreover, since a darker shade is usually produced on the end faces of workpieces, the counter electrode requires intricate masking.

It has also been proposed to make suitably combined use, in the electrolysis of the anodized basis metal in accordance with the above described prior art process, of alternating and direct currents or of other currents similar to or quite dissimilar from such currents in waveform. This practice also has drawbacks such as the complexity of equipment required and the difficulty of control. Another disadvantage arises from the fact that according to such known methods, the degree or depth of coloring of successive workpieces must be controlled by the period of electrolysis. It has been highly difficult to eliminate differences in the coloring degree of the workpieces because of the inevitable personal differences of personnel engaged in color matching operation.

SUMMARY OF THE INVENTION

It is therefore an object of this invention to provide an improved process for uniformly coloring aluminum and aluminum alloys by electrolysis.

Another object of the invention is to provide a process of the character described such that aluminum or aluminum alloy can be colored to a desired constant degree.

A further object of the invention is to provide a process of the character described such that colored coatings formed on aluminum or aluminum alloy have excellent weather resistance and other properties.

In accordance with this invention, briefly stated, aluminum or aluminum alloy is first anodized to form an oxide film thereon. The anodized basis metal is then electrolyzed in an electrolytic solution by use of alternating current, with the voltage at which the electrolysis is effected being lowered at least once. The electrolytic solution contains either: (1) at least three metallic salts; or (2) at least two metallic salts and a strongly reducing compound.

The above and other objects, features and advantages of this invention will become more apparent and understandable from the following detailed description, Examples and claims.

DETAILED DESCRIPTION OF THE INVENTION

Aluminum and aluminum alloys to be colored by the process of this invention comprise pure aluminum and the alloys of pure aluminum and one or more of such elements as silicon, magnesium, copper, zinc, chromium, lead, bismuth, iron, titanium, and manganese.

For anodizing aluminum or any of such aluminum alloys, the basis metal may first be degreased, rinsed and otherwise suitably pretreated in the conventional manner. The pretreated basis metal is made anodic in the usual acid electrolytic solution containing sulfuric acid, oxalic acid, sulfamic acid or the like, and electric current is passed through the solution between the anodic basis metal and a cathode also immersed therein as the counter electrode.

In accordance with this invention, the anodized basis metal is then subjected to electrolysis by use of alternating current at a preselected starting voltage, with the voltage being lowered at least once during the progress of the electrolysis. The electrolysis is effected in an electrolytic solution which contains either at least three metallic salts or at least two metallic salts and a strong reducing compound.

The metallic salts for use in the electrolytic solution according to the invention can be selected, for example, from such inorganic acid salts as nitrates, sulfates, phosphates, hydrochlorides and chromates, and such organic acid salts as oxalates, acetates and tartrates, of various metals typically comprising nickel, cobalt, chromium, copper, magnesium, iron, cadmium, titanium, manganese, molybdenum, calcium, vanadium, tin, lead, and zinc. The electrolytic solution contains at least three of such metallic salts, or at least two of such metallic salts and a strong reducing compound. The concentration of the total amount of any two or more selected metallic salts in the electrolytic solution should be in the range of from about 5 to 500 grams per liter and, for the best results, from about 10 to 250 grams per liter.

A strong reducing compound to be added as required to the electrolytic solution according to the invention can be selected, for example, from such dithionites (hydrosulfites) as sodium dithionite and zinc dithionite; such thiosulfates as ammonium thiosulfate, sodium thiosulfate, potassium thiosulfate and iron thiosulfate; such bisulfites as sodium hydrogen sulfite and potassium hydrogen sulfite; sulfurous acid; such sulfites as ammonium sulfite, sodium sulfite and potassium sulfite; thioglycolic acid; and such thioglycolates as ammoinum thioglycolate, sodium thioglycolate, potassium thioglycolate and lithium thioglycolate. The concentration of any selected reducing compound in the electrolytic solution should be in the range of from about 0.05 to 10 grams per liter and, for the best results, from about 0.5 to 3 grams per liter.

The use of an aqueous solution of at least three selected metallic salts, or of at least two selected metallic salts and a selected strongly reducing compound, as the electrolytic solution in the process of this invention is effective not only to produce coatings of desired colors but also to speed the progress of coloring and to improve the uniformity of colored coatings produced.

Usually, there is further added to the electrolytic solution for use in the process of this invention at least one of such inorganic acids as sulfuric acid, nitric acid, hydrochloric acid, phosphoric acid, boric acid, thiocyanic acid and chromic acid; such organic acids as oxalic acid, acetic acid, propionic acid, formic acid, tartaric acid and malic acid; and their ammonium salts, amino salts and imino salts. The concentration of any selected one of these substances in the electrolytic solution should be in the range of from about 5 to 250 grams per liter.

Still more improved results will be realized by further adding to the electrolytic solution any of such organic substances as toluenesulfonic acid, sulfosalicylic acid, hydrazine sulfate, and maleic acid anhydride.

For electrolytically coloring aluminum or aluminum alloy in accordance with this invention, the anodized basis metal together with a counter electrode is immersed in the electrolytic solution which has been prepared as above described, and alternating current is passed through the solution. It is an essential feature of this invention that the voltage impressed across the electrodes is lowered at least once during the progress of the electrolysis.

The uniformity of coloring on various surfaces of aluminum or aluminum alloy workpieces can be achieved by suitably selecting the instant at which the voltage is decreased, the voltage values at which the electrolysis is conducted, and the difference between the starting and the subsequently lowered voltages. It is also possible, through suitable control of the voltages, to substantially limit the degree or depth to which the workpieces can be colored, so that the finished workpieces will have little or no difference in the shade of their color. Furthermore, the throwing power can be so improved that, as has been confirmed experimentally, three extruded aluminum or aluminum alloy specimens each sized 150 millimeters by 70 by 1.3 can be colored uniformly on all their surfaces when anodized and subsequently subjected to simultaneous electrolysis with constant spacings of 10 millimeters therebetween and with the use of a single counter electrode, in accordance with the process of this invention.

The effects of lowering the voltage in the course of electrolysis according to the invention are explained hereafter, on the assumption that the electrolytic solution in use has the composition set forth in Inventive Example I given hereinbelow. The greater the difference between the starting and the final voltages, the better is the uniformity of color produced, but the lower is the progress of coloring. Colors produced are poor in uniformity if the voltage is lowered too early or too late following the start of electrolysis, so that the optimum instant for the voltage change should be ascertained previously. Also, if the electrolysis is carried out at voltages at or near the lower limit of the voltage range in which coloring is possible, the basis metal will be colored only to a substantially limited degree.

In consideration of the foregoing, the starting voltage of electrolysis according to the invention should be in the range of from about 6 to 50 volts and, for the best results, from about 10 to 30 volts. In the course of electrolysis the voltage should be lowered from about 1 to 10 volts. Generally, the higher is the starting voltage, the greater should be the difference between the starting and the final voltages. The voltage should be lowered within about 2 minutes and, for the best results, in about 5 to 60 seconds, following the start of electrolysis.

Only a decrease in voltage is effective to attain the objects of this invention. The degree and speed of coloring depend on the specific voltages in use, the difference therebetween, and the instant at which the voltage is decreased. These conditions, when suitably determined in relation to each other, provide improved results, particularly if the electrolytic solution has a suitably elevated temperature. In practice, however, the bath temperature should be determined in consideration of such factors as the composition of the bath, its stability, the progress of sealing due to its temperature rise, and the drying of the workpieces at the time of the subsequent color matching operation. Usually, the bath temperature may range from room temperature to about 50° C.

The pores in the oxide films on workpieces which have been colored by the process of the invention as above described may be sealed by boiling water, by steam, or by superheated steam, as has been known heretofore. After, or without, the sealing treatment, the colored surfaces may be coated with a suitable resin paint as by the dipping or electrodeposition method for protection purposes.

The inventive process is hereinafter described more specifically in terms of several Inventive Examples, which, however, are meant purely to illustrate or explain and not to impose limitations upon the invention. Also given hereinbelow are some Comparative Examples which are intended to make clear the advantages of the inventive process.

INVENTIVE EXAMPLE I

Two specimens each consisting of an aluminum extrusion sized 150 millimeters by 70 by 1.3 were degreased, etched and desmutted in the usual manner. The thus pretreated specimens were each made anodic in an aqueous solution of 17.5 W/V % sulfuric acid, and a DC voltage of 15 volts was impressed for 35 minutes across the anodic specimen and an aluminum cathode connected as the counter electrode in the bath. The current density was 1.2 amperes per square decimeter. An anodic oxide film with a thickness of about 12 microns was thus formed on each specimen, which was then rinsed.

For electrolytically coloring the above anodized specimens, there was used a vessel with a length of 300 millimeters, a width of 100 millimeters and a height of 150 millimeters. This vessel was filled with an electrolytic solution of the following composition:

Nickel sulfate (hexahydrate)—30 g/l
Mangesium sulfate (heptahydrate)—15 g/l
Boric acid—20 g/l
Ammonium sulfate—30 g/l
Sodium dithionite—0.5 g/l The pH of the above electrolytic solution was 5.6, and its temperature was 20° C.

The two anodized specimens which had been prepared as above were immersed in the solution with a spacing of 10 millimeters therebetween and a single counter electrode was positioned at a distance of 250 millimeters from the specimens. The specimens were then subjected to electrolysis for 20 seconds by use of alternating current at a potential of 24 volts, and then for three minutes by use of alternating current at a potential of 18 volts. All the four surfaces of the two specimens were uniformly colored in bronze.

The above obtained colored films on the specimens were then subjected to sealing treatment for 30 minutes by live steam, under pressure of five kilograms per square centimeter. A 3000-hour accelerated weathering test of the finished specimens by means of a weatherometer developed no change in their colored surfaces.

Also, no change in color took place when the specimens were heated to a temperature of 200° C for two hours, and the specimens remained intact when subjected to a 16-hour CASS (copper-accelarated acetic acid salt spray) test. It has thus been confirmed that aluminum or aluminum alloy colored by the process of this invention lends itself to use, for example, as structural members which will sufficiently withstand outdoor use.

INVENTIVE EXAMPLE II

Two aluminum extrusions each sized 150 millimeters by 70 by 1.3 were anodized by use of the procedure described in Inventive Example I to form thereon an oxide film with a thickness of about 12 microns. The anodized specimens were rinsed and were subsequently electrolyzed, first for 20 seconds by use of alternating current at a potential of 21 volts and then for three minutes by use of alternating current at a potential of 16 volts, in an electrolytic solution of the following composition:

Nickel sulfate (hexahydrate)—25 g/l
Magnesium sulfate (heptahydrate)—15 g/l
Boric acid—20 g/l
Ammonium sulfate—30 g/l
Cobalt sulfate (heptahydrate)—25 g/l The pH of this electrolytic solution was 5.6, and its temperature was 20° C. The specimens were uniformly colored deep bronze as in Inventive Example I.

The pores in the thus obtained colored films on the specimens were sealed in the manner set forth in Inventive Example I. The finished specimens exhibited the same favorable results as those of the preceding Example when subjected to a 3000-hour accelerated weathering test by means of a weatherometer, a 2-hour heating test at a temperature of 200° C, and a 16-hour CASS test.

INVENTIVE EXAMPLE III

Two aluminum extrusions each sized 150 millimeters by 70 by 1.3 were anodized by use of the procedure of Inventive Example I to form thereon an oxide film with a thickness of about 12 microns. After having been rinsed, the anodized specimens were electrolyzed, first for 15 seconds by use of alternating current at a potential of 19 volts and then for 10 minutes by use of alternating current at a potential of 16 volts, in the same electrolytic solution as in Inventive Example II. The specimens were uniformly colored black on all their surfaces.

The pores in the thus produced colored films on the specimens were sealed by the same means as in Inventive Example I. The finished specimens exhibited the same favorable results as those of Inventive Example I when subjected to a 3000-hour accelerated weathering test by means of a weatherometer, a 2-hour heating test at a temperature of 200° C, and a 16-hour CASS test.

INVENTIVE EXAMPLE IV

By use of the procedure of Inventive Example I, two aluminum extrusions of the size described above were anodized to form thereon an oxide film with a thickness of about 12 microns. After having been rinsed, the anodized specimens were electrolyzed, first for 30 seconds by use of alternating current at a potential of 21 volts and then for three minutes by use of alternating current at a potential of 16 volts, in an electrolytic solution of the following composition:

Nickel sulfate (hexahydrate)—30 g/l
Magnesium sulfate (heptahydrate)—30 g/l
Boric acid—25 g/l
Ammonium sulfate—30 g/l
Ferrous sulfate (heptahydrate)—20 g/l The pH of this electrolytic solution was 5.6, and its temperature was 20° C. The specimens were uniformly colored greenish bronze on all their surfaces.

The pores in the thus produced colored films on the specimens were sealed by the means described in Inventive Example I. The finished specimens, when subjected to the same tests as are described in Inventive Example I, exhibited the same favorable results as are described above.

INVENTIVE EXAMPLE V

By use of the procedure of Inventive Example I, two aluminum extrusions of the size described above were anodized to form thereon an oxide film with a thickness of about 12 microns. After having been rinsed, the anodized specimens were electrolyzed, first for 20 seconds by use of alternating current at a potential of 15 volts and then for three minutes by use of alternating current at a potential of 12 volts, in an electrolytic solution of the following composition:

Nickel sulfate (hexahydrate)—30 g/l
Magnesium sulfate (heptahydrate)—10 g/l
Boric acid—10 g/l
Ammonium sulfate—30 g/l
Sodium dithionite—0.5 g/l The pH of this electrolytic solution was 5.6, and its temperature was 40° C. The specimens were uniformly colored bronze on all their surfaces.

The pores in the thus produced colored films on the specimens were sealed by the means described in Inventive Example I. The finished specimens, when subjected to the tests listed in Inventive Example I, exhibited the same favorable results as described above.

INVENTIVE EXAMPLE VI

By use of the procedure of Inventive Example I, two aluminum extrusions of the size described above were anodized to form thereon an oxide film with a thickness of about 12 microns. After having been rinsed, the anodized specimens were electrolyzed, first for 30 seconds by use of alternating current at a potential of 24 volts and then for 4 minutes by use of alternating current at a potential of 18 volts, in an electrolytic solution of the following composition:

Nickel sulfate (hexahydrate)—25 g/l
Magnesium sulfate (heptahydrate)—30 g/l
Boric acid—25 g/l
Ammonium sulfate—30 g/l
Ammonium thiosulfate—0.5 g/l
p-toluenesulfonic acid—1.0 g/l The pH of this electrolytic solution was 5.6, and its temperature was 25° C. The specimens were uniformly colored deep bronze on all their surfaces.

The pores in the thus produced colored films on the specimens were sealed by the means described in Inventive Example I. The finished specimens, when subjected to the tests listed in Inventive Example I, exhibited the same favorable results as are described above.

INVENTIVE EXAMPLE VII

By use of the procedure of Inventive Example I, two aluminum extrusions of the size described above were anodized to form thereon an oxide film with a thickness of about 12 microns. After having been rinsed, the anodized specimens were electrolyzed, first for 20 seconds by use of alternating current at a potential of 17 volts and then for four minutes by use of alternating current at a potential of 13 volts, in an electrolytic solution of the following composition:

Copper sulfate (pentahydrate)—7 g/l
Magnesium sulfate (heptahydrate)—7 g/l
Ammonium sulfate—30 g/l
Cobalt sulfate (heptahydrate)—7 g/l The pH of this electrolytic solution was 4.0, and its temperature was 20° C. The specimens were uniformly colored reddish brown on all their surfaces.

The pores in the thus produced colored films on the specimens were then sealed by the means described in Inventive Example I. The finished specimens, when subjected to the tests listed in Inventive Example I, exhibited the same favorable results as are described above.

COMPARATIVE EXAMPLE I

By use of the procedure of Inventive Example I, two aluminum extrusions of the size described above were anodized to form thereon an oxide film with a thickness of about 12 microns. The specimens were rinsed and then electrolyzed for four minutes by use of alternating current at a potential of 16 volts in an electrolytic solution of the following composition:

Nickel sulfate (hexahydrate)—25 g/l
Magnesium sulfate (heptahydrate)—20 g/l
Boric acid—25 g/l
Ammonium sulfate—30 g/l The pH of the above electrolytic solution was 5.6, and its temperature was 20° C.

The two specimens were colored bronze. One of their surfaces which had been located closest to the counter electrode, however, was colored a significantly darker shade than the other three surfaces. Moreover, the color of the said other three surfaces became generally lighter with the increase in distance from the counter electrode, and the color of each of these three surfaces became still lighter toward its center.

COMPARATIVE EXAMPLE II

Two aluminum extrusions of the size described above were anodized and rinsed by use of the procedure described in Inventive Example I. The anodized specimens were then electrolyzed in the electrolytic solution of Comparative Example I, first for 20 seconds by use of alternating current at a potential of 24 volts and then for four minutes by use of alternating current at a potential of 16 volts. The specimens were colored extremely light beige on all their surfaces. The shade of the color on these surfaces remained substantially unchanged when the specimens were further electrolyzed in the solution for five minutes at a potential of 16 volts.

INVENTIVE EXAMPLE VIII

To the electrolytic solution of Comparative Example I was added, in accordance with the teaching of this invention, 1.0 gram per liter of ammonium thiosulfate, and the pH of the overall solution was regulated to 5.6. Two aluminum extrusions of the size described above, which had been anodized and rinsed by use of the procedure described in Inventive Example I, were electrolyzed in this electrolytic solution by use of the procedure of Comparative Example II, that is, first for 20 seconds by use of alternating current at a potential of 24 volts and then for four minutes by use of alternating current at a potential of 16 volts. The two specimens were uniformly colored bronze on all their surfaces.

COMPARATIVE EXAMPLE III

By use of the procedure of Inventive Example I, two aluminum extrusions of the size described above were anodized to form thereon an oxide film with a thickness of about 12 microns. The anodized specimens were rinsed and then electrolyzed for four minutes by use of alternating current at a potential of 16 volts in an electrolytic solution of the following composition:

Nickel sulfate (hexahydrate)—25 g/l
Magnesium sulfate (heptahydrate)—20 g/l
Boric acid—25 g/l
Ammonium sulfate—30 g/l
Cobalt sulfate (heptahydrate)—25 g/l The pH of this electrolytic solution was 5.6, and its temperature was 20° C.

The two specimens were colored bronze. One of their surfaces which had been located closest to the counter electrode, however, had a significantly darker shade than the other three surfaces. Moreover, the color of the said other three surfaces became lighter with the increase in distance from the counter electrode, and the color of each of these three surfaces became still lighter toward its center.

INVENTIVE EXAMPLE IX

Two aluminum extrusions of the size described above were anodized and rinsed through the procedure described in Inventive Example I. The anodized specimens were then electrolyzed in the electrolytic solution of Comparative Example III in accordance with the teaching of this invention, that is, first for 20 seconds by use of alternating current at a potential of 24 volts and then for four minutes by use of alternating current at a potential of 16 volts. The aluminum extrusions were uniformly colored bronze on all their four surfaces.

INVENTIVE EXAMPLES X - XIII

In the electrolytic solution of Inventive Example I, the following strong reducing compounds were used in lieu of sodium dithionite to prepare four different solutions:

| Example | Strongly Reducing Compound | Concentration (g/l) | pH |
|---|---|---|---|
| X | Thioglycolic acid | 1.5 | 4.5 |
| XI | Ammonium thioglycolate | 1.5 | 5.6 |
| XII | Ammonium sulfite | 2.0 | 5.6 |
| XIII | Ammonium hydrogen sulfite | 1.0 | 5.6 |

Two aluminum extrusions of the size described above were anodized, rinsed, and electrolyzed in each of the above electrolytic solutions, by use of the procedure of Inventive Example I. The results were as favorable as those set forth in Inventive Example I.

What is claimed is:

1. A process for electrolytically coloring aluminum or aluminum alloy which comprises anodizing a desired basis metal, and electrolyzing the anodized basis metal in an acidic aqueous electrolyte by use of a constantly applied alternating current, the voltage at which the anodized basis metal is electrolyzed being lowered at least once by a value of from about 1 to 10 volts but not to a sustained zero potential in the course of the electrolysis.

2. The process as recited in claim 1, wherein the anodized basis metal is electrolyzed at a starting voltage in the range of from about 6 to 50 volts.

3. The process as recited in claim 1, wherein the voltage is lowered within about 2 minutes following the start of the electrolysis.

4. The process as recited in claim 1, wherein the electrolyte contains at least three metallic salts in a concentration of 5 to 500 grams per liter.

5. The process as recited in claim 4, wherein the metallic salts are selected from the group consisting of inorganic and organic acid salts of nickel, cobalt, chromium, copper, magnesium, iron, cadmium, titanium, manganese, molybdenum, calcium, vanadium, tin, lead, and zinc.

6. The process as recited in claim 1, wherein the electrolyte contains at least two metallic salts and a strong reducing compound selected from the group consisting of dithionites, thiosulfates, bisulfites, sulfurous acid, sulfites, thioglycolic acid, and thioglycolates in a concentration of from about 0.05 to 10 grams per liter.

7. The process as recited in claim 6, wherein the metallic salts are selected from the group consisting of inorganic and organic acid salts of nickel, cobalt, chromium, copper, magnesium, iron, cadmium, titanium, manganese, molybdenum, calcium, vanadium, tin, lead, and zinc.

* * * * *